US007861792B2

(12) United States Patent
Andersen et al.

(10) Patent No.: US 7,861,792 B2
(45) Date of Patent: Jan. 4, 2011

(54) FIRE SUPPRESSION SYSTEM

(75) Inventors: Thomas Dahl Andersen, Frederiksberg (DK); Peter O Jensen, Albertslund (DK); Robert Lade, Buckinghamshire (GB); Robert Dunster, Buckinghamshire (GB); Simon Davies, Staines (GB)

(73) Assignee: Kidde IP Holdings Limited, Berkshire (GB)

( * ) Notice: Subject to any disclaimer, the term of this patent is extended or adjusted under 35 U.S.C. 154(b) by 523 days.

(21) Appl. No.: 11/376,689

(22) Filed: Mar. 14, 2006

(65) Prior Publication Data

US 2007/0034387 A1 Feb. 15, 2007

(30) Foreign Application Priority Data

Mar. 14, 2005 (GB) ..... 0505198.2

(51) Int. Cl.
*A62C 35/00* (2006.01)
*A62C 2/00* (2006.01)

(52) U.S. Cl. ..... 169/9; 169/11; 169/45; 169/46

(58) Field of Classification Search ..... 169/11, 169/43, 44, 45, 16, 17, 9, 19, 20, 37, 46
See application file for complete search history.

(56) References Cited

U.S. PATENT DOCUMENTS 2,023,569 A * 12/1935 Allen et al. ..... 169/11
4,109,726 A * 8/1978 Hansen et al. ..... 169/11
5,857,525 A 1/1999 Okamoto et al.
6,068,205 A * 5/2000 Vari ..... 239/533.1

(Continued)

FOREIGN PATENT DOCUMENTS

EP 0 574 663 A1 12/1993

(Continued)

OTHER PUBLICATIONS

European Search Report mailed Apr. 22, 2008.

*Primary Examiner*—Davis Hwu
(74) *Attorney, Agent, or Firm*—Kinney & Lange, P.A.

(57) ABSTRACT

A system for discharging inert gas for extinguishing or suppressing a fire is disclosed. A fluid discharge control arrangement is positioned in a fluid flow path between a pressurised gas supply 10A,10B,10C and the target fire suppression zone 20. The fluid discharge control arrangement reduces the pressure in the fluid flow path downstream thereof. This may allow the downstream pipework to be selected to withstand a lower pressure than in a conventional system in which the fluid discharge control device was not provided, thereby reducing costs. The fluid discharge control device may comprise a first valve 30 and first restrictor 26 in the first flow path 22 and a second valve 32 and a second restrictor 28 provided in the second flow path 24. Fluid from the containers 10A, 10B,10C flows initially through flow path 24 and restrictor 26. Subsequently flow path 22 may be closed by optional valve 30, and flow path 24 is opened by valve 32. Fluid flow then passes through restrictor 28. This reduces the peak pressure in the downstream pipework 34. In another embodiment the discharge of inert gas from the containers 10A,10B and 10C is staggered to reduce the peak pressure in pipeline 34. A further embodiment provides a restrictor in the inlet 14A, 14B,14C from each of the containers 10A,10B,10C to the manifold 16, thereby also reducing the peak pressure in the pipeline 34.

14 Claims, 3 Drawing Sheets

U.S. PATENT DOCUMENTS

| | | | | |
|---|---|---|---|---|
| 6,588,512 | B2 * | 7/2003 | Sundholm | 169/5 |
| 6,801,132 | B2 * | 10/2004 | Clauss et al. | 340/577 |
| 6,871,802 | B2 * | 3/2005 | Stilwell et al. | 239/583 |

FOREIGN PATENT DOCUMENTS

| | | | |
|---|---|---|---|
| EP | 1 116 499 | A1 | 7/2001 |
| EP | 1 260 248 | A3 | 11/2002 |
| FR | 2 578 336 | | 9/1986 |
| GB | 2 386 835 | | 10/2003 |
| IE | 930461 | | 12/1993 |
| WO | 2004/079678 | A2 | 9/2004 |

* cited by examiner

FIRE SUPPRESSION SYSTEM

FIELD OF THE INVENTION

The present invention relates to a system and method for discharging an inert gas for extinguishing or suppressing a fire.

BACKGROUND ART

Inert gas fire suppression systems are being used to replace systems using Halon suppressants because such Halon-based systems are considered to be damaging to the environment. Systems using inert gas are generally required by safety standards to deliver inert gas to a room or other target zone so that the inert gas occupies approximately 40% by volume of the room. This lowers the oxygen level within the room to about 10 to 15%, which starves a fire of oxygen. The safety standards generally require that 95% of the required amount of inert gas is delivered to the protective room within sixty seconds. Preferably, the inert gas is selected so as not to be harmful to any occupants of the room, and may be so selected that the atmosphere in the room is breathable even after deployment of the fire suppressant gas.

In order to provide the desired rate of delivery to the protected room, the inert gas is typically stored in a plurality of containers at very high pressure, such as 200 to 300 bar. Each of these containers is connected to a manifold which supplies the inert gas, when required, to the target room. Such a known arrangement is shown in FIG. 1.

Because the highly pressurised inert gas must be supplied to the target room rapidly, it is necessary to provide the target room with vent areas so as to reduce the peak pressure within the target room and avoid structural damage upon discharge of such high volumes of gas. Also, the manifold and piping from the manifold to the target room must be capable of withstanding the high peak pressure generated when fluid is discharged from each of the plurality of containers simultaneously. Such heavy duty piping is expensive.

WO-A-2004/079678 (Fike Corporation) discloses an inert gas fire suppression system in which the inert gas is stored in a plurality of pressurised containers. Each of the containers is provided with a respective specially designed discharge valve which is said to control the discharge of gas so that it is delivered at a generally constant pressure. The discharge valve has a complex structure, and controls the flow rate of fluid from the pressurised container in dependence upon variations in the pressure of that container.

BRIEF SUMMARY OF THE INVENTION

According to a first aspect of the present invention, there is provided a system for discharging inert gas for extinguishing or suppressing a fire, including fluid discharge control means for being positioned in a fluid flow path between a pressurised inert gas supply and a target fire suppression zone for reducing the pressure in the fluid flow path downstream of the fluid discharge control means without reference to the pressure in the fluid flow path upstream of the fluid discharge control means.

Advantageously this system is operable to reduce the peak pressure in the fluid flow path when the pressurised inert gas supply is initially discharged. The control means may reduce the applied pressure reduction after the initial discharge stage, when the pressure in the inert gas supply is lower. The pressure in the fluid flow path downstream of the control means is maintained generally constant—or at least below a maximum pressure that would be present in the absence of the control means.

There may be a series of substantially identical peaks in pressure.

In some of the embodiments, the fluid discharge control means operates without any indication of the pressure in the fluid flow path upstream of the fluid discharge control means. For example, the fluid discharge control means is operated in dependence upon lapsed time. This is in contrast to WO-A-2004/079678.

In other embodiments an indication of the pressure in the fluid flow path upstream of the fluid discharge control means is used to operate the fluid discharge control means.

According to a second aspect of the present invention, there is provided a system for discharging inert gas for extinguishing or suppressing a fire, in which the inert gas is stored in a plurality of pressurised containers, the system including a fluid discharge control means for being positioned in a fluid flow path between said plurality of pressurised containers and a target fire suppression zone for reducing the pressure in the fluid flow path downstream of the fluid discharge control means.

Advantageously this system is operable to reduce the peak pressure in the fluid flow path when the pressurised inert gas supply is initially discharged. The control means may reduce the applied pressure reduction after the initial discharge stage, when the pressure in the inert gas supply is lower. The pressure in the fluid flow path downstream of the control means is maintained generally constant—or at least below a maximum pressure that would be present in the absence of the control means.

There may be a series of substantially identical peaks in pressure.

In some of the embodiments the fluid discharge control means is downstream of all the pressurised containers. A separate fluid discharge control means is not required for each pressurised container. This is in contrast to WO-A-2004/079678.

According to a third aspect of the present invention, there is provided a method of discharging inert gas for extinguishing or suppressing a fire, including providing fluid discharge control means positioned in a fluid flow path between a pressurised inert gas supply and a target fire suppression zone for reducing the pressure in the fluid flow path downstream of the fluid discharge control means without reference to the pressure in the fluid flow path upstream of the fluid discharge control means.

According to a fourth aspect of the present invention, there is provided a method of discharging inert gas for extinguishing or suppressing a fire, in which the inert gas is stored in a plurality of pressurised containers, the method including providing a fluid discharge control means positioned in a fluid flow path between said plurality of pressurised containers and a target fire suppression zone for reducing the pressure in the fluid flow path upstream of the fluid discharge control means.

BRIEF DESCRIPTION OF THE DRAWINGS

For a better understanding of the present invention, a system and method for discharging inert gas for extinguishing or suppressing a fire will now be described with reference to the accompanying drawings in which.

In the drawings like elements are generally designated with the same reference sign.

DETAILED DESCRIPTION OF EMBODIMENTS OF THE INVENTION

Figure 1:
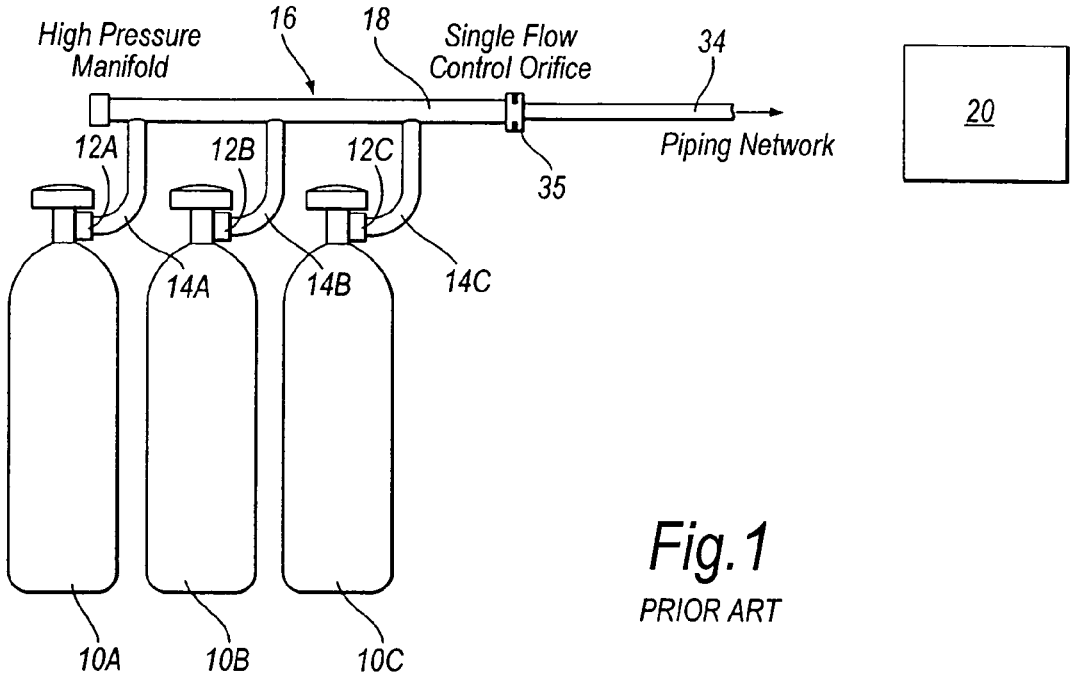
Fig. 1 PRIOR ART
FIG. 1 shows schematically a prior art inert gas suppressing system.

The known system in FIG. 1 employs a plurality of containers 10A,10B,10C (three of which are shown in FIG. 1), each of which contain inert gas stored at very high pressure (between 200 and 300 bar). Each of the containers 10A,10B, 10C is provided with a check valve 12A,12B,12C which, when activated, enables discharge of inert gas from each of the containers 10A,10B,10C into respective inlet pipes 4A,14B,14C of manifold 16. The manifold outlet pipe 18 discharges fluid to piping network 34 via a single flow control orifice (or restrictor) 35. Because of the very high pressure of the inert gases within the containers 10A,10B,10C, fluid pressures within the piping network 34 of up to 60 bar are commonplace.

Figure 2:
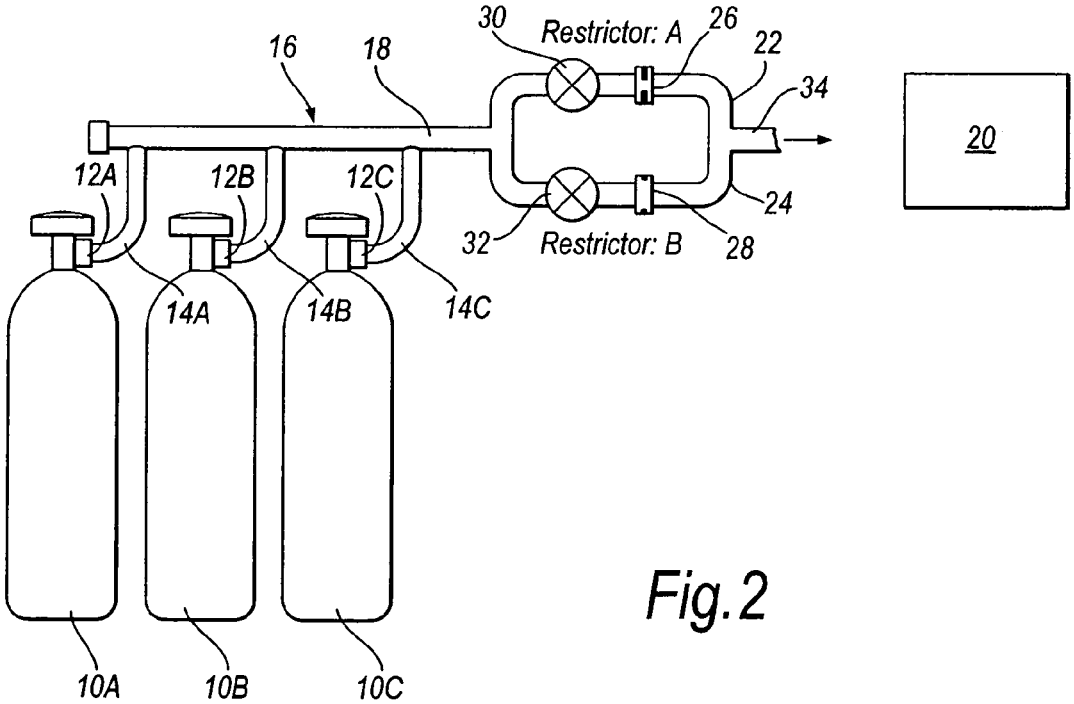
FIG. 2 shows schematically an inert gas fire suppressing system in accordance with a first embodiment of the invention.

FIG. 2 shows a first embodiment of the invention. Three containers 10A,10B,10C each contain inert gas stored at very high pressure. In the embodiment only three containers are shown, although it should be appreciated that many more containers may be employed, the number of containers being selected according to the application. In the embodiment, each of the containers contains a blend of 50% argon and 50% nitrogen, and may comprise Argonite® fire suppressant available from Kidde. The fire suppressant may be stored in the containers at a pressure of between 200 and 300 bar(g). The type and proportion of inert gases within the containers, and the pressure at which the inert gas is stored in the containers, will be determined in accordance with the application of the fire suppression system.

Each of the containers 10A, 10B and 10C is provided with a check valve 12A,12B,12C which, when opened, enables discharge of the inert gas from each of the containers into respective inlet pipes 14A,14B,14C of manifold 16. The check valves, 12A,12B,12C allow fluid flow in one direction only—from the containers 10A,10B,10C to the manifold 16.

The manifold outlet pipe 18 discharges fluid via piping network 34 to a target zone 20, such as a room or other enclosed volume in which fire extinguishing or suppression might be required. The outlet pipe 18 is split to provide two separate flow paths 22 and 24. The flow paths 22 and 24 each have a respective flow restrictor 26,28 and a respective electro-pneumatic valve 30,32 upstream of the associated restrictor 26,28. The first restrictor 26 provides a greater restriction of fluid flow than the second restrictor 28 (that is, the size or diameter of the fluid flow passage through the first restrictor 26 is smaller than that of the second restrictor 28).

In use, fluid discharge from the containers 10A,10B,10C is initiated, the valve 30 is open and valve 32 is closed. Inert gas from the containers 10A,10B,10C is therefore diverted or directed along the first flow path 22 and flows through the first restrictor 26 via the first valve 30. The operation of the first restrictor 26 results in there being a relatively low pressure and mass flow within the pipework 34 downstream of the first restrictor 26.

After a predetermined time has elapsed, at which time the pressure and mass flow rate of the inert gas in the pipeline 18 will be significantly reduced from their initial values (due to partial discharge of the fluid in the containers 10A,10B,10C), the first value 30 is closed and the second valve 32 is opened, the closure and opening happening simultaneously or substantially simultaneously. Because the second restrictor 28 has a relatively large cross-section or diameter, this reduces the pressure drop between pipeline 18 and pipeline 34.

Figure 3:
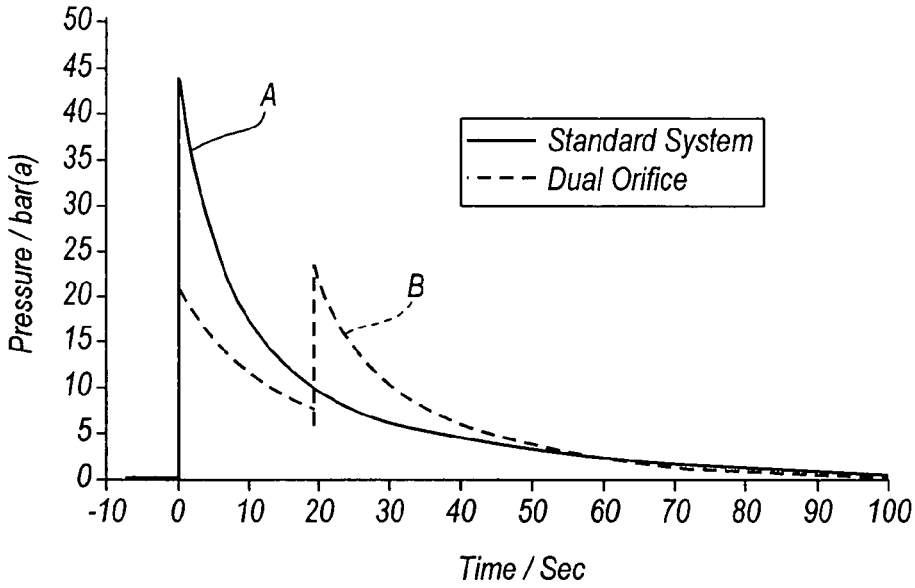
FIG. 3 shows a graph showing flow path pressure against time for the prior art suppression system and the suppression system of the first embodiment.

FIG. 3 shows the pressure decay curve for a standard inert gas fire suppression system of FIG. 1 (line A) and the system of FIG. 2 (line B). In the known fire suppression system of FIG. 1, a peak nozzle pressure (the pressure at the nozzle that discharges inert gas into the room 20—typically having a diameter of 25 mm) occurs when inert gas discharge is initiated. The nozzle pressure then rapidly decays.

In contrast, the system of FIG. 2 shows two peak nozzle pressures. The first peak occurs when the containers begin their initial discharge of inert gas (which is directed through only first flow path 22), and a second peak after an elapsed time of approximately 20 seconds, when the inert gas flows through second flow path 24 and not through first pipeline 22. Each of the peaks has approximately the same value. The peak nozzle pressure of the FIG. 2 system is approximately half the peak nozzle pressure of the known FIG. 1 system. Thus, the restrictors 26,28 are operated to produce a series of substantially identical peak pressures.

In the embodiment the first restrictor 26 has a diameter of 7 millimeters and the second restrictor 28 has a diameter of 14 millimeters. Different values may be selected in accordance with the application. Although in the embodiment the first restrictor 26 has half the diameter of the second restrictor 28, this size ratio is not essential to the invention.

It is described above how, after a first predetermined time interval, the second valve 32 is opened and the second valve 30 is closed. Optionally, after a second predetermined time interval, both first valve 30 and second valve 32 may be opened so that inert gas from the containers 10A,10B,10C can flow through the first flow path 22 and the second flow path 24 simultaneously and in parallel, thereby further reducing the pressure drop between the pipeline 18 and the pipeline 34. The valve 30 may optionally be omitted, leaving the flow path 22 open always. The flow rate is altered by opening and closing the valve 32.

Alternatively, the valves 30 and 32 may be replaced by a single tree-way valve positioned at the "T" junction of the flow paths 22,24 with the manifold outlet pipe 18. Such a valve could select through which flow path (or paths) 22,24 the fluid flows. Other valve arrangements may also be used, depending on the application.

The operation of the electro-pneumatic valves 30,32 may be controlled remotely by an ancillary power supply and a suitably programmed microprocessor or a standard timing unit available from electronic component suppliers.

Although in the embodiment of FIG. 2 the operation of the valves 30,32 is described as occurring at a predetermined time, the valve 32 could instead be operated when the pressure in the pipeline 18 and/or 34 reaches a predetermined value.

If desired more than two flow paths may be provided between the pipelines 18 and 34—each of which is provided with a valve and restrictor.

Figure 4:
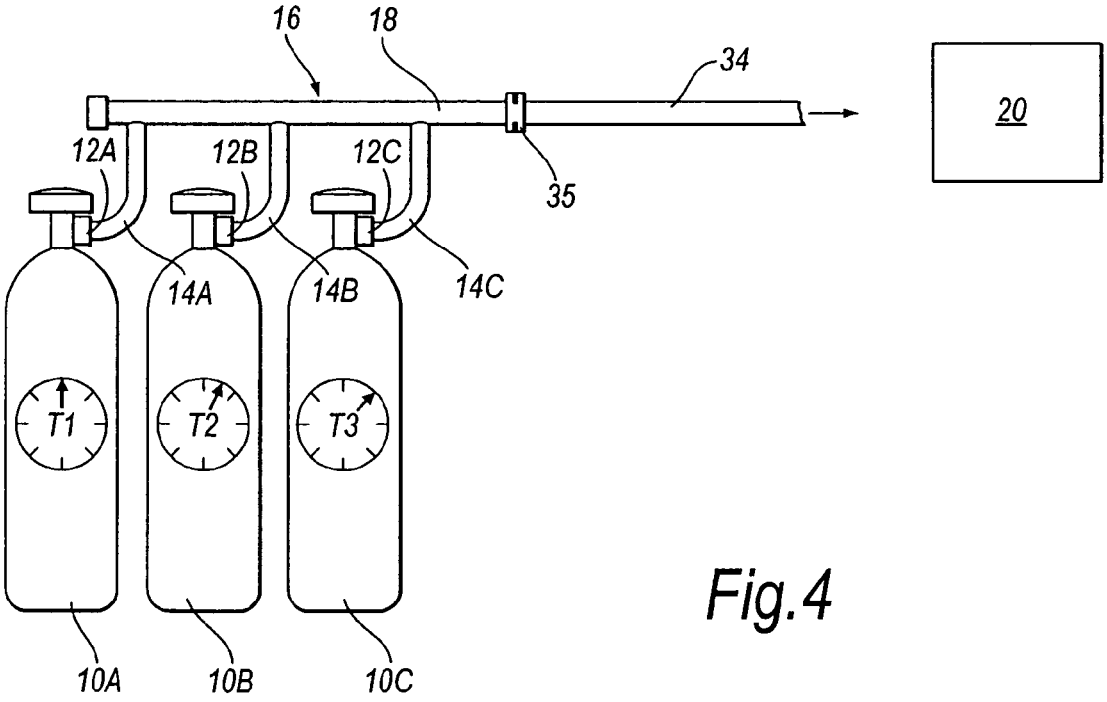
FIG. 4 shows schematically a suppression system according to a second embodiment of the invention.

FIG. 4 shows a second embodiment of the invention in which the three inert gas containers 10A,10B and 10C (identical to those of the first embodiment) are connected to a conventional piping network 14A,14B,14C,16,18,34 via a single flow control orifice 35 in a similar manner to the known arrangement shown in FIG. 1. However, the check valves 12A,12B,12C of the respective containers 10A,10B,10C are controlled so that they are opened at different times. For example, the times at which the respective check valves 12A, 12B,12C are operated may be staggered.

Figure 5:
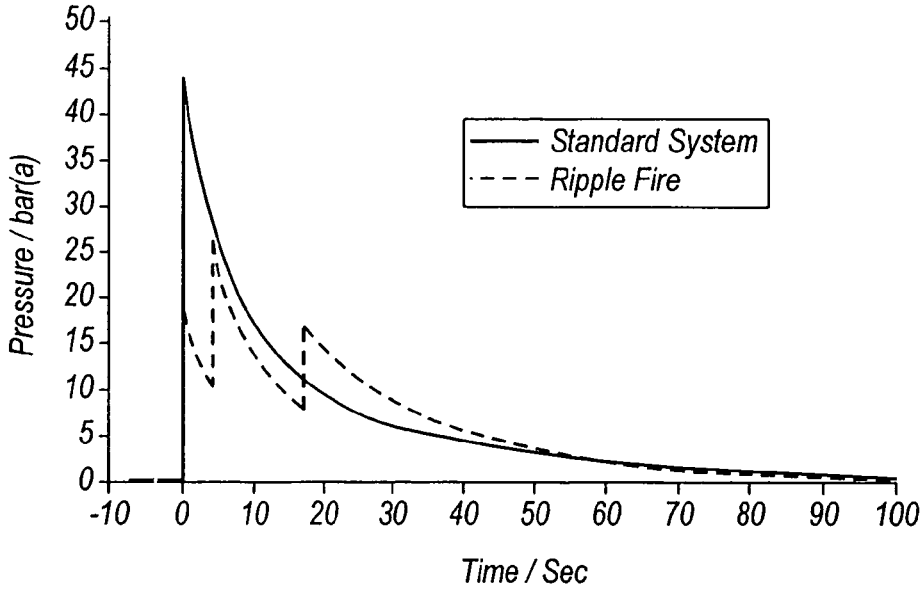
FIG. 5 shows a graph of pressure in the flow path against time for the prior art suppression system and the suppression system of the second embodiment.

The graph of FIG. 5 shows the peak nozzle pressure of the known inerting system of FIG. 1 (line A) and the peak nozzle pressure of the inerting system of FIG. 4 (line B).

The check valve 12A of container 10A is opened to initiate fire suppression (T=0), with the check valves 12B and 12C remaining closed. This results in the first peak shown in the graph of FIG. 5. After a delay of 3.95 seconds (T=3.95 s) the check valve 12B is opened (with the check valve 12A remaining open and the check valve 12C being closed). This results in the second peak shown in the graph of FIG. 5. After a time delay of 17.1 seconds (T=17.1 s) from fire suppression initiation, the check valve 12C of the third container 10C is opened (with the check valves 12A and 12B also remaining open). This results in the third peak shown in the graph of FIG. 5. The peak nozzle pressure in the system of the second embodiment shown in FIG. 4 is 12.6 bar (g), which is a 40% reduction compared to the known system of FIG. 1.

Although in the FIG. 4 embodiment only three containers 10A,10B,10C are shown, it should be understood that more or fewer containers might be employed, depending on the application. For applications where a larger number of containers, say six containers, are required, the check control valves of the respective containers may be operated so that the check valves of a plurality of containers are opened simultaneously (or substantially simultaneously). For example, at time T=0, the check valves of three of the six containers could be opened. At time T=Xs, the check valves of a further two of the six containers could be opened, and at time T=(X+Ys), the check control valve of the remaining container could be opened.

The check valves 12A,12B,12C may be electro-pneumatically operated by an auxiliary power supply and a microprocessor or a standard timing unit available from electronic component suppliers.

In the FIG. 4 embodiment, instead of the respective check valves 12A,12B and 12C being opened at predetermined times, the check valves 12B and 12C could be opened when a predetermined pressure is detected in the pipeline 18 and/or 34.

Figure 6:
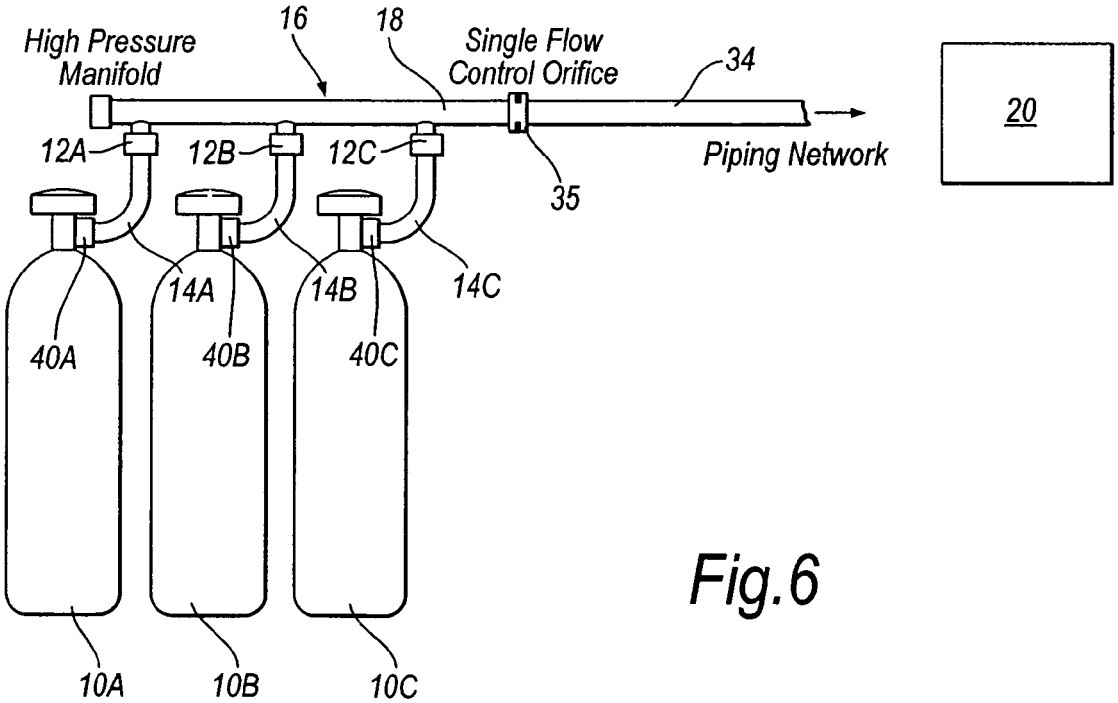
FIG. 6 shows schematically a suppression system according to a third embodiment of the invention.

In a third embodiment, shown in FIG. 6, the inert gas suppression system of FIG. 1 is modified so that the inlet pipe 14A,14B,14C of each container 10A,10B,10C is provided with a respective restrictor 40A,40B,40C. The restrictors 40A,40B,40C may be provided downstream of the check valve 12A,12B,12C at each container.

The size of each restrictor 40A,40B,40C may be determined by calculating an area equal to one third of that of the restrictor used for the three cylinder known standard system (i.e. the 12 millimeter restrictor used in the system shown in FIG. 1 equated to three 6.93 millimeter individual restrictors in the FIG. 6 embodiment, with a 7 millimeter restrictor being sufficient). The same logic can be applied to a two cylinder system with a 10 millimeter restrictor, with the individual restrictors having a diameter of 7.07 millimeters (with 7 millimeters being sufficient). The same restrictor size can be used for each of the cylinders 10A,10B,10C of a fire suppression system, or for at least a plurality of the cylinders of a fire suppression system.

An advantage of the third embodiment of FIG. 6 is that the manifold 16 does not have to be able to withstand such a high peak discharge pressure. For example, in the known system of FIG. 1, the manifold 16 must be able to withstand fluid at a pressure at which it is stored in the containers 10A,10B,10C (typically between 200 and 300 bar). By providing a restrictor 40A,40B,40C for each of the containers 10A,10B,10C, the peak pressure that the manifold 16 needs to withstand can be reduced (for example can be halved).

Each of the three embodiments described allows at least a portion of the piping network between the pressurised gas inert containers and the target zone 20 to be made so that it need only withstand lower pressures than in the known system shown in FIG. 1. This is because the peak pressure in the piping network is reduced. This reduced peak pressure also allows the vent areas described above in relation to the prior art to be reduced in area or eliminated.

The first and second embodiments provide a series of peak pressures in the piping network. The peaks are staggered over time. The peaks may be substantially identical in pressure.

The invention claimed is:

1. A system for discharging inert gas for extinguishing or suppressing a fire, including fluid discharge control means for being positioned in a fluid flow path between a pressurised inert gas supply and a target fire suppression zone for reducing the pressure in the fluid flow path downstream of the fluid discharge control means without reference to the pressure in the fluid flow path upstream of the fluid discharge control means, wherein the system includes a controller for controlling the fluid discharge control means with reference to time elapsed from the initial discharge of fluid from the pressurised gas supply whereby to reduce said reduction in pressure applied by the fluid discharge control means after an initial discharge stage and when the pressure in the inert gas supply has fallen.

2. The system of claim 1, wherein the fluid discharge control means comprises means for restricting the gas flow in the fluid flow path.

3. The system of claim 1, wherein the fluid discharge control means includes an obstruction in the fluid flow path.

4. The system of claim 3, including a plurality of obstructions in the fluid flow path.

5. The system of claim 4, wherein said fluid flow path includes a portion having a plurality of channels through which the fluid can pass, and wherein a respective one of said plurality of obstructions is provided in each of said channels.

6. The system of claim 5, wherein the fluid discharge control means controls through which of the channels the fluid flows.

7. The system of claim 1, wherein said pressurised gas supply comprises a plurality of pressurised containers.

8. The system of claim 7, wherein the fluid discharge control means is positioned downstream of all of said plurality of pressurised containers.

9. The system of claim 7, wherein the said fluid discharge control means includes a plurality of devices, one of which is associated with each of said containers for controlling the discharge of fluid from that container only.

10. The system of claim 9, including means for activating each of the respective fluid discharge control means at a selected time such that the fluid discharge from at least two of said containers is initiated at different times.

11. The system of claim 1, wherein the inert gas includes argon and nitrogen.

12. The system of claim 11, wherein the inert gas includes argon and nitrogen in equal proportions.

13. The system of claim 12, wherein the inert gas consists only of argon and nitrogen.

14. A method of discharging inert gas for extinguishing or suppressing a fire, including using a fluid discharge control means positioned in a fluid flow path between a pressurised inert gas supply and a target fire suppression zone to reduce the pressure in the fluid flow path downstream of the fluid discharge control means without reference to the pressure in the fluid flow path upstream of the fluid discharge control means, and controlling the fluid discharge control means with reference to time elapsed from the initial discharge of fluid from the pressurised gas supply whereby to reduce said reduction in pressure applied by the fluid discharge control means after an initial discharge stage and when the pressure in the inert gas supply has fallen.

* * * * *